United States Patent [19]

Ackermann

[11] Patent Number: 4,798,924

[45] Date of Patent: Jan. 17, 1989

[54] COMPRESSED-GAS BREAKER

[75] Inventor: Ulrich Ackermann, Turgi, Switzerland

[73] Assignee: BBC Brown Boveri & Co., Ltd., Switzerland

[21] Appl. No.: 194,019

[22] Filed: May 12, 1988

[30] Foreign Application Priority Data

May 13, 1987 [CH] Switzerland ..... 1840/87

[51] Int. Cl.[4] ..... H01H 33/70

[52] U.S. Cl. ..... 200/148 R; 200/148 A; 200/148 B

[58] Field of Search ..... 200/148 A, 148 R, 148 B

[56] References Cited

U.S. PATENT DOCUMENTS 4,427,862 1/1984 Lin ..... 200/146 R

FOREIGN PATENT DOCUMENTS 0163943 12/1985 European Pat. Off. .
0028039 12/1986 European Pat. Off. .
3425633 12/1985 Fed. Rep. of Germany .
1541143 10/1968 France .
2287764 5/1976 France .
939445 10/1963 United Kingdom .

*Primary Examiner*—Robert S. Macon
*Attorney, Agent, or Firm*—Ostrolenk, Faber, Gerb & Soffen

[57] ABSTRACT

The compressed-gas breaker exhibits two contact members (3; 11, 12, 13), of which one (11, 12, 13) is constructed as a nozzle, and an insulating nozzle (5) and a heating volume (8) for storing switching-arc-generated compressed gas.

This breaker is intended to be distinguished by a high pressure buildup in the heating volume (8) and a great thermal quenching capacity.

This is achieved by a multi-part construction of the contact member (11, 12, 13) acting as a nozzle. In particular, this contact member (11, 12, 13) exhibits a tubular body (13), which is axially displaceably conducted in a contact carrier (11), of erosion-resistant contact material, which, during interruption, forms the nozzle constriction (19) of this contact member (11, 12, 13) while under the action of a spring (15).

3 Claims, 2 Drawing Sheets

COMPRESSED-GAS BREAKER

BACKGROUND OF THE INVENTION

1. Field of the Invention

The invention is based on a compressed-gas breaker having two contact members, which can be brought into or out of engagement with one another along one axis, of which a first one is constructed as a nozzle and exhibits contact fingers elastically mounted on a tubular contact carrier, having an insulating nozzle and having a heating volume for storing switching-arc-generated compressed gas, in which, in the operated condition, a second one of the two contact members is conducted through the constriction of the insulating nozzle and is inserted, with a free end, into the first contact member whilst forming a contact force with the contact fingers, and in which, during interruption, compressed gas flows from the heating volume through the insulating nozzle and the first contact member into an exhaust space.

2. Discussion of Background

In this connection, the invention refers to a prior art of compressed-gas breakers described, for example, in DE-A No. 1-34 25 633. In the known compressed gas breakers, compressed gas is generated with the aid of the switching arc during the high-current phase during interruption and stored in a heating volume. When the current to be disconnected approaches a zero transition, the stored compressed gas removes energy from the switching arc by axial blasting and thus causes it to be extinguished. During this process, a considerable proportion of the compressed gas stored in the heating volume can already be removed, before the zero transition of the current, into the exhaust space of the breaker by means of a contact member constructed as a nozzle, depending on the magnitude of the current to be disconnected. The greater the cross-section of the nozzle, the greater this proportion of compressed gas removed from the heating volume. However, the nozzle cross-section is in most cases defined by particular boundary conditions such as, for example, contact erosion, insulating nozzle erosion and/or magnitude of the shortcircuit current to be disconnected. For these reasons, the known compressed-gas breaker exhibits a further constriction downstream of the nozzle constriction of the nozzle-shaped contact member in the embodiment according to FIG. 3. This further constriction closes off a volume which is limited by the upstream part of the contact member and which supports the heating power of the switching arc during interruption and causes a pressure increase in the heating volume. However, such a breaker does not exhibit an optimum thermal quenching capacity which is dependent on arc edge turbulences since the switching arc is now no longer conducted through the narrowest location in the compressed-gas flow at which the arc edge turbulences are at a maximum.

SUMMARY OF THE INVENTION

The invention defined in claim 1 achieves the object of specifying a compressed-gas breaker which is distinguished by a high pressure buildup in the heating volume and a great thermal quenching capacity. The compressed-gas breaker according to the invention is distinguished by a high short-circuit carrying capability and a high thermal quenching capacity. This is due to the fact, on the one hand, that high short-circuit currents can be conducted because of the suitably constructed contact member which acts as a quenching nozzle and, at the same time, the compressed gas generated by the switching arc is largely prevented from flowing away into the exhaust space. On the other hand, however, this is also due to the fact that the contact member acting as a quenching nozzle exhibits optimum behavior with respect to flow when the current to be disconnected approaches a zero transition.

It is true that a compressed-gas breaker having a multi-part quenching current contact constructed for the removal of quenching gas is known from EP-B No. 1-0,028,039. This quenching current contact contains an arcing ring, arranged on a contact carrier, for receiving a root of the switching arc, and a ring of contact fingers, which can be axially displaced in the contact carrier under the action of a spring, for conducting the current to be disconnected when the quenching current contacts are closed. In the case of this breaker, however, the contact fingers forming a constriction of the quenching current contact are only intended to prevent contact bouncing during operation. The constriction of the quenching current contact is of unfavorable construction with respect to flow so that no high arc edge turbulences can be generated by means of this breaker. In addition, the switching arc is not intended to pass through the constriction causing the greatest arc edge turbulences in this breaker.

BRIEF DESCRIPTION OF THE DRAWINGS

In the text which follows, the invention will be explained in greater detail with reference to illustrative embodiments shown in the drawing, in which.

In both figures, identical reference symbols also designate parts acting in identical manner and the compressed-gas breaker according to the invention is in each case shown in the operated condition in the right-hand part and during interruption in the left-hand part.

Figure 1:
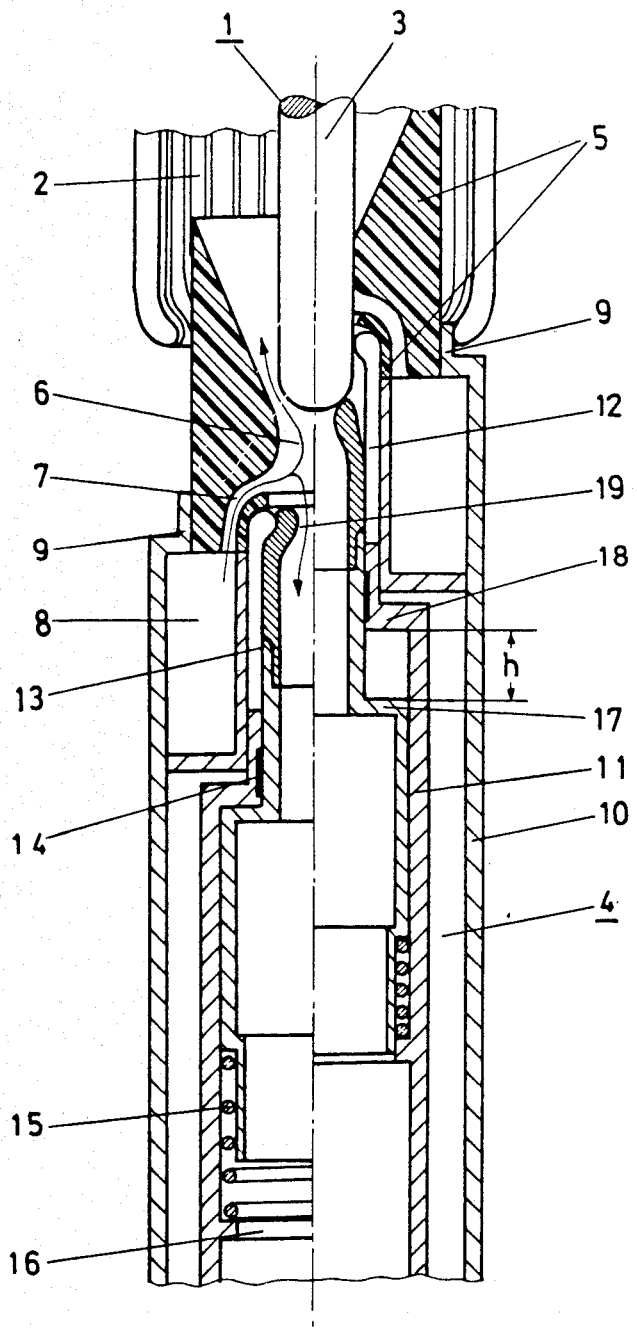
FIG. 1 shows a top view of a contact arrangement, cut in the axial direction, of a first embodiment of the compressed-gas breaker according to the invention.

In the embodiment of the compressed-gas breaker according to the invention, shown in FIG. 1, a fixed contact member 1 having a rated-current contact 2 and a fully cylindrically constructed erosion-resistant contact member 3, and a contact member 4 which can be moved along an axis by a drive mechanism (now shown), are located in a housing, (not shown), filled with an arc-quenching insulating gas. The contact member 4 carries at its end facing the contact member 1 an insulating nozzle 5, consisting, for example, of polytetrafluoroethylene, having a constriction 6. In the insulating nozzle 5, an annular duct 7 is recessed which connects the constriction 6 with an annularly constructed heating volume 8 which is radially outwardly limited by a tubular rated-current contact carrier 10, intended for carrying a rated-current contact 9, of the contact member 4. The contact member 4 also exhibits a tubular contact carrier 11 which is electrically conductively connected to the rated-current contact carrier 10 and is enclosed by the latter. At the end of the contact carrier 11 facing the contact member 1, annularly arranged contact fingers 12 are elastically mounted. The elastically mounted contact fingers 12 can be formed, for example, by axially conducted cuts in the contact carrier 11.

In the contact carrier 11, an axially displaceable tubular body 13 is conducted, the end of which facing the contact member 1 consists of erosion-resistant material. The tubular body 13 is in continuous electrical connection with the contact carrier 11, and thus with a current connection, (not shown), for the contact member 4, via an annular sliding contact 14. The end of the tubular body 13 facing away from the contact member 1 is braced against a spring 15 which, in turn, is supported on an annular projection 16 of the contact carrier 11. The tubular body 13 and the tubular contact carrier 11, respectively, also exhibit a step-shaped expansion 17 and 18, respectively, in each case.

In the operated condition, the two contact members 1 and 4 are in engagement with one another (right-hand part of FIG. 1) and the current to be disconnected predominantly flows along the rated-current path formed by the rated-current contacts 2, 9. The erosion-resistant contact member 3 is conducted in an almost gas-tight manner through the constriction 6 of the insulating nozzle 5 and is inserted with its free end into the contact member 4. In this arrangement, the contact fingers 12, forming a contact force, are elastically braced against the surface area of the contact member 3 and the contact member 3 has conducted the tubular body 13 into the interior of the contact member 4 whilst loading the spring 15.

During interruption, the contact member 4 is conducted downwards by the drive mechanism (not shown) and initially the rated-current contacts 2, 9 separate. The current to be disconnected is then predominantly commutated into a current path extending from the contact member 3 via the contact fingers 12 and the contact carrier 11. During the further interruption movement, the contact member 3 and the contact fingers 12 separate. Since, in this connection, the tubular body 13, being under the effect of the loaded spring 15, is continuously braced against the free end of the contact member 3 whilst forming contact pressure, the current to be disconnected is commutated into the quenching current path formed by the contact member 3, the tubular body 13, the sliding contact 14 and the contact carrier 11. After the expansion 17 of the tubular body 13 has impinged on the expansion 18, the tubular body 13 and the contact member 3 then also separate and a switching arc is drawn between these two parts. This switching arc heats up surrounding insulating gas which is conducted via the annular duct 7 into the heating volume 8 where it is stored. When the current to be disconnected approaches a zero transition, the heating effect of the switching arc greatly decreases and the compressed gas stored in the heating volume 8 then flows, as shown by direction arrows in the left-hand part of FIG. 1, through the constriction 6, which in the meantime has been opened, of the insulating nozzle 5 and through a nozzle constriction 19, determined by the tubular body 13, away into an exhaust space and while doing so quenches the switching arc.

The breaker according to the invention, compared with a comparable breaker without an axially displaceably arranged tubular body of erosion-resistant material and forming a nozzle constriction, exhibits, on the one hand, the advantage that the diameter of the nozzle constriction 19 can be freely selected. The result is that the pressure loss occurring during the forming of compressed gas due to heating-up by the switching arc can be kept extremely low before the zero transition of the current in spite of the fact that a contact member 3 having a large diameter and suitable for conducting high currents is used. On the other hand, however, the breaker according to the invention exhibits the advantage that it is possible, by choosing a suitable distance h (right-hand part of FIG. 1) between the two expansions 17 and 18 determining the trailing distance of the tubular body 13 during interruption, to bring the tubular body 13 acting as a quenching nozzle to an optimum position with respect to flow.

Figure 2:
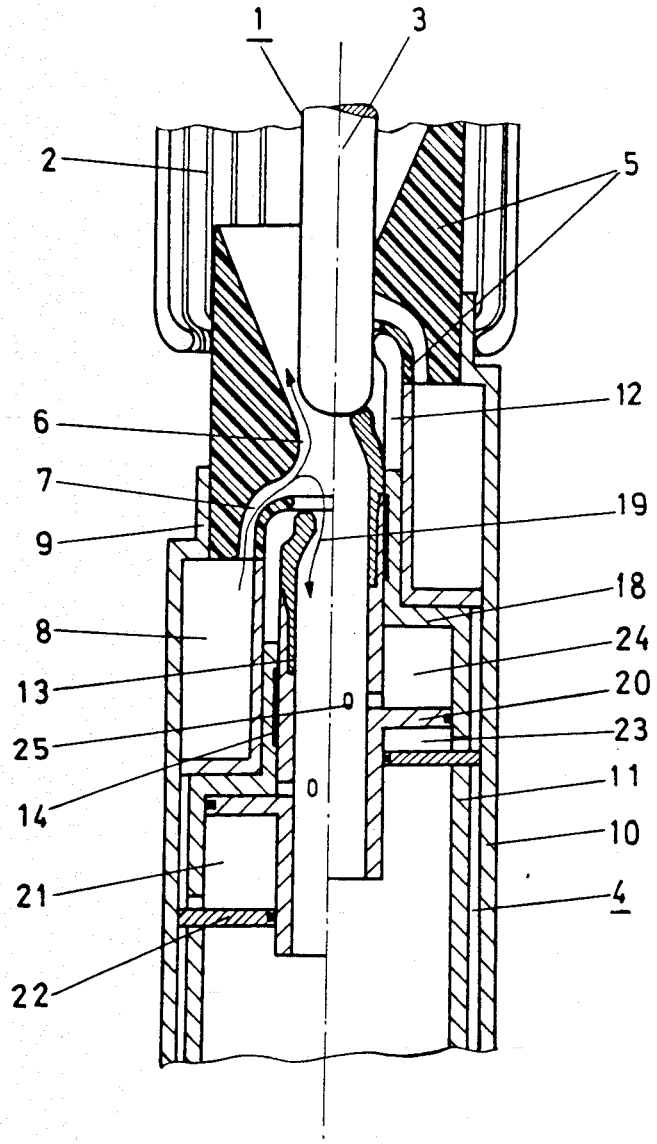
FIG. 2 shows a top view of a contact arrangement, cut in the axial direction, of a second embodiment of the compressed-gas breaker according to the invention.

In the case of the compressed-gas breaker according to the invention, according to FIG. 2, unlike the compressed-gas breaker according to FIG. 1, the tubular body 13 forming a nozzle constriction 19 during interruption is not driven by a spring but by an arrangement, containing a piston 20 and a cylinder 21, which is actuated by the compressed gas stored in the heating volume 8 during interruption. In this compressed-gas breaker, the piston 20 is constructed as an annular piston which is directly connected to the tubular body 13. This annular piston slides in a gas-tight manner in the cylinder 21 which is limited by the contact carrier 11 and a bottom 22. During interruption, the part space 23, located below the piston 20, of the cylinder 21 is supplied with compressed gas formed by the switching arc and stored in the heating volume 8, so that the tubular body 13 is displaced upwards until it has reached the position shown in the left-hand part of FIG. 2 in which it acts as a quenching nozzle. To prevent gas located in a part space 24, located above the piston 20, of the cylinder 21 from making the movement of the piston 20 more difficult, holes 25 are provided in the tubular body 13 which enable this gas to flow away unimpeded into the exhaust space.

With respect to its quenching characteristics, this breaker corresponds to the breaker according to FIG. 1 but, unlike the latter, it does not require a spring and can be adapted in a simple manner, by a suitable choice of the effective area of the piston 20, to the pressure to be expected depending on the breaker type, of the compressed gas stored in the heating volume 8 during interruption.

What is claimed as new and desired to be secured by Letters Patent of the United States is:

1. Compressed-gas breaker having two contact members (3; 11, 12, 13) which can be brought into or out of engagement with one another along one axis, of which a first one (11, 12, 13) is constructed as a nozzle and exhibits contact fingers (12) elastically mounted on a tubular contact carrier (11), having an insulating nozzle (5) and having a heating volume (8) for storing switching-arc-generated compressed gas, in which, in the operated condition, a second one (3) of the two contact members (3; 11, 12, 13) is conducted through the constriction (6) of the insulating nozzle (5) and is inserted, with a free end, into the first contact member (11, 12, 13) whilst forming a contact force with the contact fingers (12), and in which, during interruption, compressed gas flows from the heating volume (8) through the insulating nozzle (5) and the first contact member (11, 12, 13) into an exhaust space, wherein the first contact member (11, 12, 13) exhibits a tubular body (13), which is axially displaceably conducted in the contact carrier (11), of erosion-resistant contact material, and which forms, during interruption, the nozzle constriction (19) of the first contact member (11, 12, 13) whilst under the action of a driving mechanism.

2. Compressed-gas breaker as claimed in claim 1, wherein the driving mechanism contains a spring (15), which is loaded by the second contact member (3) during operation.

3. Compressed-gas breaker as claimed in claim 1, wherein the driving mechanism contains a piston (20)/cylinder (21) arrangement actuated by the stored compressed gas during interruption.

* * * * *